US007462393B2

(12) United States Patent
Damani et al.

(10) Patent No.: US 7,462,393 B2
(45) Date of Patent: Dec. 9, 2008

(54) SPRAY POWDER FOR THE MANUFACTURE OF A THERMALLY INSULATING LAYER WHICH REMAINS RESISTANT AT HIGH TEMPERATURES

(75) Inventors: Rajiv J. Damani, Winterthur (CH); Kaspar Honegger, Wallenwil (CH)

(73) Assignee: Sulzer Metco (US) Inc., Westbury, NY (US)

( * ) Notice: Subject to any disclaimer, the term of this patent is extended or adjusted under 35 U.S.C. 154(b) by 361 days.

(21) Appl. No.: 10/705,642

(22) Filed: Nov. 10, 2003

(65) Prior Publication Data

US 2004/0106015 A1 Jun. 3, 2004

(30) Foreign Application Priority Data

Nov. 22, 2002 (EP) ..... 02406010

(51) Int. Cl.
*B32B 5/16* (2006.01)

(52) U.S. Cl. ..... 428/402; 428/403; 428/404; 427/212; 427/214; 427/213.3; 427/215; 427/419.2

(58) Field of Classification Search ..... 428/402, 428/403, 404; 427/212, 214, 213.3, 215, 427/419.2

See application file for complete search history.

(56) References Cited

U.S. PATENT DOCUMENTS

| | | | | | |
|---|---|---|---|---|---|
| 3,655,425 | A | * | 4/1972 | Longo et al. | 75/230 |
| 4,599,270 | A | * | 7/1986 | Rangaswamy et al. | 428/402 |
| 4,645,716 | A | * | 2/1987 | Harrington et al. | 428/472 |
| 4,996,117 | A | | 2/1991 | Chu et al. | |
| 5,059,095 | A | | 10/1991 | Kushner et al. | |
| 5,722,379 | A | | 3/1998 | Binder et al. | |
| 5,827,797 | A | * | 10/1998 | Cass et al. | 505/430 |
| 6,203,927 | B1 | | 3/2001 | Subramanian et al. | |
| 6,319,615 | B1 | * | 11/2001 | Jansen | 428/469 |
| 6,395,080 | B1 | * | 5/2002 | Cass et al. | 106/166.01 |
| 6,582,763 | B1 | * | 6/2003 | Nishimura et al. | 427/216 |
| 6,703,334 | B2 | * | 3/2004 | Belov et al. | 501/103 |
| 6,835,449 | B2 | * | 12/2004 | Kim et al. | 428/328 |

FOREIGN PATENT DOCUMENTS

| | | | |
|---|---|---|---|
| EP | 1225251 | A2 * | 7/2000 |
| EP | 1 225 251 | A2 | 7/2002 |
| WO | WO 97/18341 | | 5/1997 |
| WO | WO 99/42630 | | 8/1999 |

* cited by examiner

*Primary Examiner*—Leszek Kiliman
(74) *Attorney, Agent, or Firm*—Townsend and Townsend and Crew, LLP

(57) ABSTRACT

The spray powder can be used for the manufacture of a thermally insulating layer which is resistant to high temperatures. A coating of this kind, a so-called TBC, can be produced on a substrate by means of a thermal spraying process. The substrate can already be coated with a single- or multi-layered part coating, in particular a primer. At least one thermally insulating functional material is used, which on the one hand has a lower thermal conductivity than the substrate and on the other hand forms a chemically and thermally stable phase at high temperatures. The spray powder comprises particles (1) which respectively have an agglomerate-like micro-structure (2) which is formed by a plurality of granules (3) adhering to each other. These granules are made up of the functional material or the functional materials. At least one further component is present made of an additive (4) or a plurality of additives. This further component is distributed finely dispersed on the surfaces (30) of the functional material granules (3), i.e. primarily in the boundary zones. The further component in the given form or in a transformed form exerts a retarding or eliminating effect with regard to sintering compounds, which can form at high temperatures between the functional material granules.

15 Claims, 1 Drawing Sheet

SPRAY POWDER FOR THE MANUFACTURE OF A THERMALLY INSULATING LAYER WHICH REMAINS RESISTANT AT HIGH TEMPERATURES

BACKGROUND OF THE INVENTION

The invention relates to a spray powder for the manufacture of a thermally insulating layer which remains resistant to high temperatures. It relates to a method for the manufacture of the spray powder in accordance with the invention and also to a substrate coated by means of a thermal spraying process and using the spray powder in accordance with the invention. The substrate is a substance from which, for example, the blade of a gas turbine wheel is made.

A thermally insulating layer of this kind is termed TBC ("thermal barrier coating". The substrate onto which the TBC is sprayed can already be coated with a single- or multi-layered partial coating, in particular a primer. A least one thermally insulating functional material is used as a coating material, which on the one hand has a strikingly lower thermal conductivity than the substrate and, on the other hand, forms a chemically and thermally stable phase at high temperatures.

Characteristics of a coating of the type TBC, its possible material composition and also problems relating to the ageing of this coating are known from EP-A-1 225 251. In this publication the main emphasis is on coatings with columnar microstructures, which can be manufactured by means of processes in which the functional material—advantageously YSZ (zirconium oxide, which is stabilized with yttrium)—is vaporized and condensed out on the surface to be coated. Such processes are PVD or sputter processes for example. Non-columnar coatings, which are likewise discussed in EP-A-1 225 251, result during thermal spraying processes using suitable powder mixtures. During thermal spraying processes an anisotropic, inhomogeneous microstructure is formed with granules, at the boundaries of which micro-pores occur, in particular also gap-shaped micro-pores.

EP-A-1 225 251 mentions the ageing of the coatings: The relatively low thermal insulation of the TBC is concerned with inhomogeneities of the microstructure, which is given by a plurality of crystal granules, wherein the boundary zones between the granules are decisive. The local density is less in these boundary zones than inside the crystals. The micro-pores and lattice defects inside the granules also have a lowering effect on the thermal conductivity. As regards the ageing processes, these are thickenings of the microstructure, which result at high temperatures due to a sintering together, namely a homogenizing growing together of micro-pores at the granule boundaries. The thermal conductivity, which should remain as low as possible, increases with higher compression. Contaminants which are present due to silicon, titanium, iron, nickel, sodium, lithium, copper, manganese, potassium and/or oxides of some of these elements result in amorphous phases, which form thin films at the granule boundaries. Amorphous phases of this kind encourage the homogenization of the coating on the basis of a sintering together of the granules. The homogenization processes can be eliminated, prevented or at least slowed down with suitable additives. An additive of this kind is aluminum oxide, which is present in the form of precipitated crystallites. These can bind the named contaminants and in addition fix the micro-pores which are located between the granules. The aluminum oxide absorbs silicates out of the films, which bind the neighboring granules. Thus gap-like empty cavities form between the neighboring granules which represent barriers for a transport of heat.

SUMMARY OF THE INVENTION

It is an object of the invention to create a spray powder for a coating of the TBC type, whose inhomogeneity, which stands in relation to the thermal conductivity, is particularly strongly pronounced and thermally durable.

The spray powder can be used for the manufacture of a thermally insulating layer which is stable at high temperatures. This TBC can be produced on a substrate by means of a thermal spraying process. The substrate can already be coated with single- or multi-layer part coating, in particular a primer. At least one thermally insulating functional material is used, which on the one hand has a lower thermal conductivity than the substrate and on the other hand forms a chemically and thermally stable phase at high temperatures. The spray powder comprises particles, which respectively have an agglomerate-like micro-structure, which is formed by a plurality of granules adhering to each other. These granules are made of the functional material or the functional materials. At least one further component made of an additive or a plurality of additives is present. This further component is distributed finely dispersed on the surfaces of the functional material granules, i.e. mainly in their boundary zones. In the given form or in a transformed form, the further components exert a retarding or eliminating effect with regard to sintering compounds, which can form at high temperatures between the functional material granules. The spray powder in accordance with the invention has specifically manufactured micro-structures of its particles. These micro-structures are maintained, at least partially, during coating by means of thermal spraying and thus lead to a strongly pronounced inhomogeneity, which is accompanied by a lower thermal conductivity. This inhomogeneity has the required durability due to suitable additives or due to materials which have resulted from a transformation from the additives.

The invention will be explained in the following on the basis of the drawings.

DESCRIPTION OF THE PREFERRED EMBODIMENTS

Figure 1:
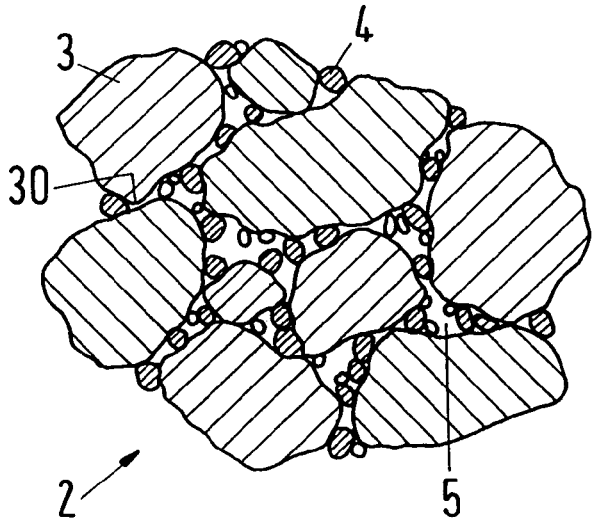
FIG. 1 is an illustration of the micro-structure, which a particle of the spray powder has in accordance with the invention.
Figure 2:
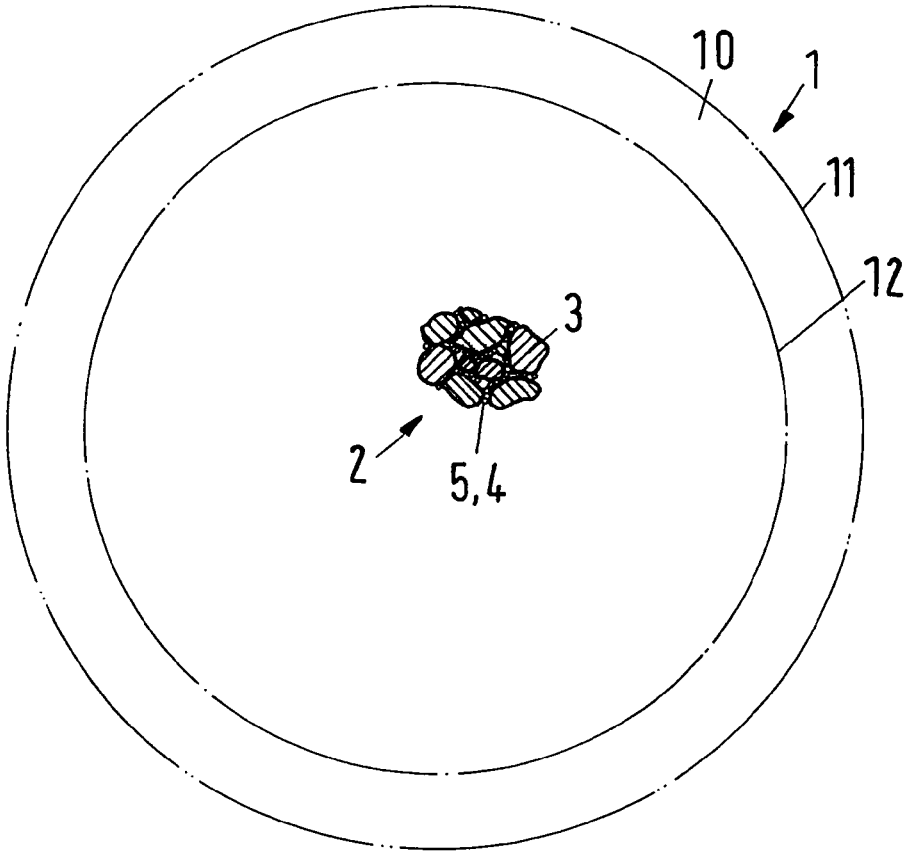
FIG. 2 is a schematic illustration of a whole particle.

The spray powder in accordance with the invention consists of particles 1 or comprises these. The particles 1 have respectively an agglomerate-like micro-structure 2, as illustrated in FIG. 1. FIG. 2 shows a schematic illustration of a cross-section through a whole particle 1, which has a boundary zone 10 between two areas 11 and 12 marked with chain-dotted lines. In this arrangement the area 11 is the surface of the particle 1. The micro-structure 2 is indicated at a point in the interior of the particle 1. The particle 1 is made up of a plurality of granules 3 adhering to each other. At the surfaces 30 of the granules 3, where they are in contact with neighboring granules, micro-pores produce low mass boundary zones 5. Lattice defects, impurity ions and/or further micro-pores (not illustrated) contribute to the reduction of the thermal conductivity inside the granules 3, which can also be polycrystalline.

Each granule 3 consists of one functional material, the function of which is to keep a flow of heat through this functional material granule 3 low at high temperatures. Different functional materials can also be present. At least one additive 4 forms a further component of the particle 1. This further component is distributed finely dispersed on the surfaces 30 of the functional material granules 3, i.e. mainly in their boundary zones 5. It exerts—if necessary after a transformation into another form—a retarding or eliminating effect with regard to homogenizing sintering effects, which occur, or can occur, at high temperatures on the surfaces of the functional material granules 3. With regard to the named transformation of the additive 4, this can initially be melted and form a new phase, together with material from neighboring functional material granules 3. The new phase co-exists with the phase of the functional material granules 3. The effect of the additive 4 which influences the sintering process is explained in EP-A-1 225 251.

It is also possible to incorporate the additive 4 in the particle 1 in a form which is first transformed into an effective form by means of an additional treatment. The additives 4 can be deposited in a phase consisting of metal salts, wherein these salts can be transformed thermally into metal oxides. Only after a transformation of the salts by means of a thermal treatment step do the additives 4 assume the effective form, namely the form which influences the sintering process.

In relation to all the components, the component which is formed from the additive 4 or the additives has a proportion of not more than 5 mol %, preferably 3 mol % at most. The functional material granules 3 have an average diameter $d_{50}$ greater than 1 nm and smaller than 10 μm, while the particles 1 of the spray powder have an average diameter $d_{50}$ in the range from 1 to 100 μm (50% by weight of the granules 3 or particles 1 are larger—or smaller—than the corresponding diameter $d_{50}$). The particle diameter $d_{50}$ is preferably in the range of 40 to 90 μm for plasma spraying processes, which are normally used. The preferred range can also be different for other processes, for example between 5 and 25 μm.

The particles 1 of the spray powder are porous agglomerates of the functional material granules 3, which contain respectively communicating, open-pore cavities open towards the outer surface 11 of the particle 1, namely the boundary zones 5. The additives 4 can be stored in these pore cavities 5 or deposited on the outer surface 11 of the particle 1.

The functional material described in EP-A-1 225 251 is zirconium oxide, in particular the stabilized zirconium oxide YSZ. This is a particularly advantageous material. Others are also possible however.

A ceramic material with a pyrochloric structure, for example lanthanum zirconate, can be used as a functional material (see U.S. Pat. No. 6,117,560, Maloney). The pyrochloric structure is specifically expressed by the formula $A_2B_20_7$, wherein A and B are elements which are present in a cationic form $A^{n+}$ and $B^{m+}$ respectively and for which the pair of values (n, m)=(3, 4) or (2, 5) apply for their charges n+ and m+. More generally the formula for the pyrochloric structure is $A_{2-x}B_{2+x}0_{7-y}$, wherein x and y are positive numbers, which are small compared with 1. The following chemical elements may be selected for A and B: A=La, Ce, Pr, Nd, Sm, Eu, Gd, Tb, Dy, Ho, Er, Tm, Yb or a mixture of these chemical elements and B=Zr, Hf, Ti.

A further possible functional material is a magnetoplumbite phase (see WO 99/42630, Gadow): $MMeAl_{11}O_{19}$, M=La, Nd and Me=Mg, Zn, Co, Mn, Fe, Ni, Cr.

For example an Al-, Mg- or La-oxide can be employed as an additive 4, further a yttrium aluminum oxide (see U.S. Pat. No. 6,203,927, Subramanian et al.) or also a spinel, in particular magnesium aluminum oxide. The following steps can be taken to incorporate the additive 4 between the functional granules 3 for example. On the one hand particle-shaped agglomerates of the functional granules 3 are manufactured and on the other hand a metal salts solution is prepared from dissolved Al-, Mg-, La-nitrate or from the corresponding acetate. The agglomerate particles are impregnated with the solution and the impregnated particles are dried. This impregnation can be repeated. A transformation into oxides, which represent the effective additives, occurs by means of a thermal treatment of the named nitrate or acetate salts. The agglomerates are won by spray drying of slurries of the functional granules 3 and subsequent sintering (calcining) of the dried intermediate product.

Each additive 4, or its modified form, effectively influencing the sintering process cannot be miscible with the functional material, so that a diffusion into the functional material is largely prevented.

A method for the manufacture of the spray powder in accordance with the invention has already been described essentially. There are also alternatives, namely an alternative A2 in addition to the A1 described:

A1) At least one of the additives 4 is introduced into a porous agglomerate of the functional material granules 3 by means of a impregnation process.

A2) The agglomerates are manufactured from a mixture of functional material granules 3 and finely dispersed additive 4, wherein the agglomerates are preferably produced by forming and spray drying of a slurry and subsequent calcination. The additive 4, for example nitrate, chloride or acetate salt, can also be introduced into the slurry in solution. Instead of a solution, a suspension is also possible, in which the additive 4 is dispersed in colloidal form.

In a concluding advantageous method step the agglomerates are introduced into a plasma flame for a short time and thus partially melted. If necessary the components can at least partially result from a thermal transformation out of the additive which brings about the inhibiting of the sintering process. Moreover a mechanically tougher form of the powder particles 1 is formed, for the reason that a partially sintered edge layer 10 occurs.

The invention claimed is:

1. A spray powder for the manufacture of a thermally insulating layer produced on a substrate by means of a thermal spraying process, wherein the substrate has already been coated with a single- or multi-layer part coating, and wherein at least one thermally insulating functional material is used, which on the one hand has a lower thermal conductivity than the substrate and on the other hand forms a chemically and thermally stable phase at elevated temperatures, characterized in that the spray powder comprises particles which have an agglomerated microstructure formed by a plurality of granules adhering to each other, the granules being made of the at least one functional material, and at least one further component made of an additive or a plurality of additives, the further component being distributed finely dispersed on surfaces of the functional material granules, the further component exerting a retarding or eliminating effect with regard to sintering compounds which form between the functional material granules, wherein surfaces of the granules comprise micro-pores that produce low mass boundary zones where the granules contact each other.

2. A spray powder in accordance with claim 1, characterized in that, in relation to all the components, the component which is formed from the additive or the additives has a proportion of not more than 5 mol %, in that the functional material granules have an average diameter $d_{50}$ greater than 1 mm and smaller than 10 μm and that the particles of the spray powder have an average diameter $d_{50}$ in the range of 1 μm to 100 μm.

3. A spray powder in accordance with claim 1, characterized in that the additive or the additives are deposited between the functional material granules of the particle in a phase comprising metal salts, wherein these salts can be transformed thermally into metal oxides, so that the additive only takes on the effective form, which influences the sintering compounds after a transformation of the salts by means of a thermal treatment step.

4. A spray powder in accordance with claim 1, characterized in that the particles contain communicating pore spaces open against an outer surface of the particle and the additive or the additives are deposited in the pore spaces and also on the outer surface.

5. A spray powder in accordance with claim 1, characterized in that the functional material granules comprise one or more of the following materials:

zirconium oxide, in particular stabilized zirconium oxide YSZ;

a ceramic material such as lanthanum zirconate, which has a pyrochloric structure $A_2B_2O_7$, wherein A and B are present in a cationic form $A^{n+}$ and $B^{m+}$, respectively with value pairs n, m=3, 4, or 2, 5 applying to their charges n+ and m+, the formula for the pyrochloric structure generally being $A_{2-x}B_{2+x}0_{7-y}$, and the following chemical elements can be selected as A and B:

A=La, Ce, Pr, Nd, Sm, Eu, Gd, Tb, Dy, Ho, Er, Tm, Yb or a mixture of these elements and B=Zr, Hf, Ti;

a magneto plumbite phase $MMeAl_{11}0_{19}$, with M=La, Nd and Me=Mg, Zn, Co, Mn, Fe, Ni, Cr;

while the additive or the additives comprise at least one of Al-, Mg-, and/or La-oxide, yttrium aluminum oxide or a spinel.

6. A spray powder in accordance with claim 1, characterized in that each additive or the transformed form of this which can effectively influence the sintering process is not miscible with the functional material, so that diffusion into the functional material is substantially avoided.

7. A method for the manufacture of a spray powder having particles which have an agglomerated microstructure formed by a plurality of granules adhering to each other, the granules being made of the at least one functional material, and at least one further component made of an additive or a plurality of additives, the further component being distributed finely dispersed on surfaces of the functional material granules, the further component exerting a retarding or eliminating effect with regard to sintering compounds which form between the functional material granules, the method comprising forming micro-pores on surfaces of the granules to produce low mass boundary zones where the granules contact each other, and wherein A1) at least one of the additives is introduced into a porous agglomerate of the functional material granules by means of an impregnating process or A2) agglomerates are manufactured from a mixture of the functional material granules and the finely dispersed additive or a homogenous or colloidal solution of the additive.

8. A method in accordance with claim 7, characterized in that, in a first step, the additives are added to the agglomerated microstructure in the form of a metal salt solution or are mixed with the granules, whereby the salts can be transformed thermally into metal oxides, in a second step the mixture is dried, and in a third step the salts are transformed by means of a thermal treatment into a form which influences the sintering process effectively.

9. A method in accordance with claim 7, characterized in that, in a concluding step, the particles are melted in a plasma flame.

10. A coated substrate comprising a thermally insulating layer manufactured from a spray powder comprising particles which have an agglomerated microstructure formed by a plurality of granules adhering to each other, the granules being made of the at least one functional material, and at least one further component made of an additive or a plurality of additives, the further component being distributed finely dispersed on surfaces of the functional material granules, the further component exerting a retarding or eliminating effect with regard to sintering compounds which form between the functional material granules, wherein surfaces of the granules comprise micro-pores that produce low mass boundary zones where the granules contact each other.

11. A spray powder according to claim 1, wherein the further component is finely dispersed in boundary zones of the surfaces.

12. A spray powder according to claim 2, wherein the component which is formed from the additive or the additives has a proportion of at most 3 mol %.

13. A spray powder according to claim 5, wherein the spinel comprises magnesium aluminum oxide.

14. A method according to claim 7, wherein the agglomerates are produced by spray drying a slurry and subsequent calcining.

15. A spray powder for the manufacture of a thermally insulating layer on a substrate comprising a plurality of agglomerated granules which adhere to each other to form particles and which are made of at least one functional material and at least one component comprising at least one additive, the component being dispersed over surfaces of the granules and retarding the formation of sintering compounds between the granules, wherein surfaces of the granules comprise micro-pores that produce low mass boundary zones where the granules contact each other.

* * * * *